US011852154B2

(12) United States Patent
Lee

(10) Patent No.: US 11,852,154 B2
(45) Date of Patent: Dec. 26, 2023

(54) CENTRIFUGAL PUMP SEALING STRUCTURE

(71) Applicant: Hyundai Kefico Corporation, Gyeonggi-do (KR)

(72) Inventor: Ahn Hee Lee, Seoul (KR)

(73) Assignee: Hyundai Kefico Corporation, Gyeonggi-do (KR)

( * ) Notice: Subject to any disclaimer, the term of this patent is extended or adjusted under 35 U.S.C. 154(b) by 0 days.

(21) Appl. No.: 17/939,642

(22) Filed: Sep. 7, 2022

(65) Prior Publication Data

US 2023/0081808 A1 Mar. 16, 2023

(30) Foreign Application Priority Data

Sep. 8, 2021 (KR) ..... 10-2021-0119513

(51) Int. Cl.

| | |
|---|---|
| ***F04D 29/08*** | (2006.01) |
| ***F04D 29/046*** | (2006.01) |
| ***F04D 29/42*** | (2006.01) |
| ***F04D 13/06*** | (2006.01) |
| ***F04D 1/00*** | (2006.01) |

(52) U.S. Cl.

CPC ..... *F04D 29/083* (2013.01); *F04D 29/046* (2013.01); *F04D 29/42* (2013.01); *F04D 1/00* (2013.01); *F04D 13/06* (2013.01)

(58) Field of Classification Search

CPC ..... F04D 29/08; F04D 29/083; F04D 29/086; F04D 29/42; F04D 13/06; F04D 13/0606

See application file for complete search history.

(56) References Cited

U.S. PATENT DOCUMENTS

| | | | | |
|---|---|---|---|---|
| 2013/0064695 | A1* | 3/2013 | Kim | F04D 13/06 417/357 |
| 2017/0152792 | A1* | 6/2017 | Hornbach | F04D 29/701 |
| 2020/0088182 | A1* | 3/2020 | Honda | F04C 29/068 |

FOREIGN PATENT DOCUMENTS

| | | | |
|---|---|---|---|
| JP | 06-047691 | | 6/1994 |
| JP | H 7-35790 | A | 7/1995 |
| JP | 2017-516950 | A | 6/2017 |
| KR | 10-0884265 | B1 | 2/2009 |

OTHER PUBLICATIONS

Office Action dated Jan. 18, 2023 issued in Korean Application No. 10-2021-0119513.

* cited by examiner

*Primary Examiner* — David E Sosnowski
*Assistant Examiner* — Jackson N Gillenwaters
(74) *Attorney, Agent, or Firm* — Fox Rothschild LLP

(57) ABSTRACT

A centrifugal pump sealing structure is provided. In one aspect, one sealing member is provided at a position where leakage paths from a fluid compression space between a middle housing and a cover and an electric component installation space between the middle housing and a lower housing are connected. Then, the two spaces are sealed. The number of sealing members is reduced, so that the internal structure becomes simpler and the assembly of the sealing member becomes easier.

9 Claims, 5 Drawing Sheets

CENTRIFUGAL PUMP SEALING STRUCTURE

CROSS-REFERENCE TO RELATED APPLICATIONS

The present application claims priority to Korean Patent Application No. 10-2021-0119513, filed Sep. 8, 2021, the entire contents of which is incorporated herein for all purposes by this reference.

FIELD

The present disclosure relates to a centrifugal pump sealing structure and more particularly to a centrifugal pump sealing structure, which is configured to be capable of maintaining the sealed state of an interior space of the centrifugal pump.

BACKGROUND

A centrifugal pump rotates a fluid by an impeller, generates pressure by a centrifugal force, thereby transferring the fluid.

FIG. 1 shows an example of the centrifugal pump. The centrifugal pump has a structure in which a rotor 1 and a stator 2 are installed within a housing 3. An impeller 1*a* is provided on one side end portion of the rotor 1 and a magnet 1*b* is provided on the outer peripheral surface. The stator 2 surrounding the periphery of the magnet 1*b* is fixed within the housing 3.

Therefore, when a current is supplied to the stator 2 and a magnetic force is generated, the magnet 1*b* reacts to the magnetic force and a rotational force is generated in the rotor 1, and then the impeller 1*a* rotates to suck, compress, and discharge the fluid.

The housing 3 is divided into an upper space and a lower space by a middle housing 3*b*. The impeller 1*a* is installed in the upper space and the stator 2 is installed in the lower space. That is, a cover 3*a* is coupled onto the middle housing 3*b*, and then a fluid compression space is provided. Also, a lower housing 3*c* is coupled under the middle housing 3*b*, and then an electric component installation space in which the stator 2, a control circuit board (PCB), etc., are installed is provided.

In addition, in order to seal the spaces within the housing 3 against the outside, an installation groove 4 is formed along the periphery of the housing 3 between the cover 3*a* and the middle housing 3*b* and between the middle housing 3*b* and the lower housing 3*c*. Also, a ring-shaped sealing member 5 is installed in the installation groove 4.

However, in the centrifugal pump sealing structure according to a prior art, the sealing member 5 is provided respectively in order to seal the upper space and the lower space with respect to the middle housing 3*b*, so that the number of sealing members 4 increases, and the assembly thereof is complicated. Also, assembly time is increased.

In addition, two-point contact where only both side ends of the conventional sealing member 5 contact both sides of the installation groove 4 within the installation groove 4 occurs. Therefore, this shows an insufficient sealing performance.

SUMMARY

In one preferred aspect, a centrifugal pump sealing structure is provided that can be capable of sealing two spaces within a housing by at least one sealing member.

In another preferred aspect, a centrifugal pump sealing structure is provided that can be capable of improving the sealing performance of the sealing member.

In one embodiment, a centrifugal pump sealing structure is provided comprising: (a) a fluid compression space formed between a middle housing and an associated cover of the middle housing; (b) an electric component installation space between the middle housing and a lower housing; and (c) a sealing member installed at a position where flow paths from the fluid compression space and the electric component installation space are connected.

In one embodiment, a centrifugal pump sealing structure comprises: a fluid compression space formed between a middle housing and a cover coupled to one side thereof; an electric component installation space between the middle housing and a lower housing coupled to the other side thereof; and one sealing member installed at a position where leakage paths from the fluid compression space and the electric component installation space are connected while ends of the cover, the middle housing, and the lower housing are adjacent to each other.

A bottom surface of the cover suitably is in close contact with an upper end of the sealing member. An upper surface of the lower housing is in close contact with a lower end of the sealing member. An outer surface of a coupling protrusion formed on an outer peripheral surface of the middle housing is in close contact with a left end of the sealing member. An inner surface of an outer protrusion formed on a radially outer side portion of a bottom surface of the cover is in close contact with a right end of the sealing member.

A bottom surface of the cover suitably is in close contact with an upper end of the sealing member. An upper surface of the lower housing is in close contact with a lower end of the sealing member. An outer surface of an inner protrusion formed on a radially inner side portion of an upper surface of the cover is in close contact with a left end of the sealing member. An inner surface of an outer protrusion formed on a radially outer side portion of the upper surface of the cover is in close contact with a right end of the sealing member.

A bottom surface of the cover suitably is in close contact with an upper end of the sealing member. An upper surface of the lower housing is in close contact with a lower end of the sealing member. An outer surface of a coupling protrusion formed on an outer peripheral surface of the middle housing is in close contact with a left end of the sealing member. An inner surface of an outer protrusion formed on a radially outer side portion of the upper surface of the lower housing is in close contact with a right end of the sealing member.

An upwardly concave coupling groove suitably is formed on a radially inner side of the coupling protrusion of the middle housing. An inner protrusion formed on a radially inner side portion of the upper surface of the lower housing is inserted into and coupled to the coupling groove.

An inner edge of the bottom surface of the cover is suitably seated on an upper edge of the coupling protrusion of the middle housing.

A rotor shaft is suitably installed to pass through the middle housing. One side end portion of the rotor shaft is suitably positioned in the fluid compression space. An impeller is installed at the end portion.

A rotor shaft is suitably installed to pass through the middle housing. The other side end portion of the rotor shaft is suitably positioned in the electric component installation space. A magnet is installed on an outer peripheral surface of the rotor shaft. A stator including a coil and a core is suitably installed on an inner peripheral surface of the lower housing in correspondence to the magnet.

A pair of upper and lower bearings supporting rotatably the rotor shaft is suitably provided. The bearings are suitably installed on an inner circumferential surface of a cylindrical portion formed in a center of the middle housing.

Other aspects are disclosed infra.

DETAILED DESCRIPTION

Figure 1:
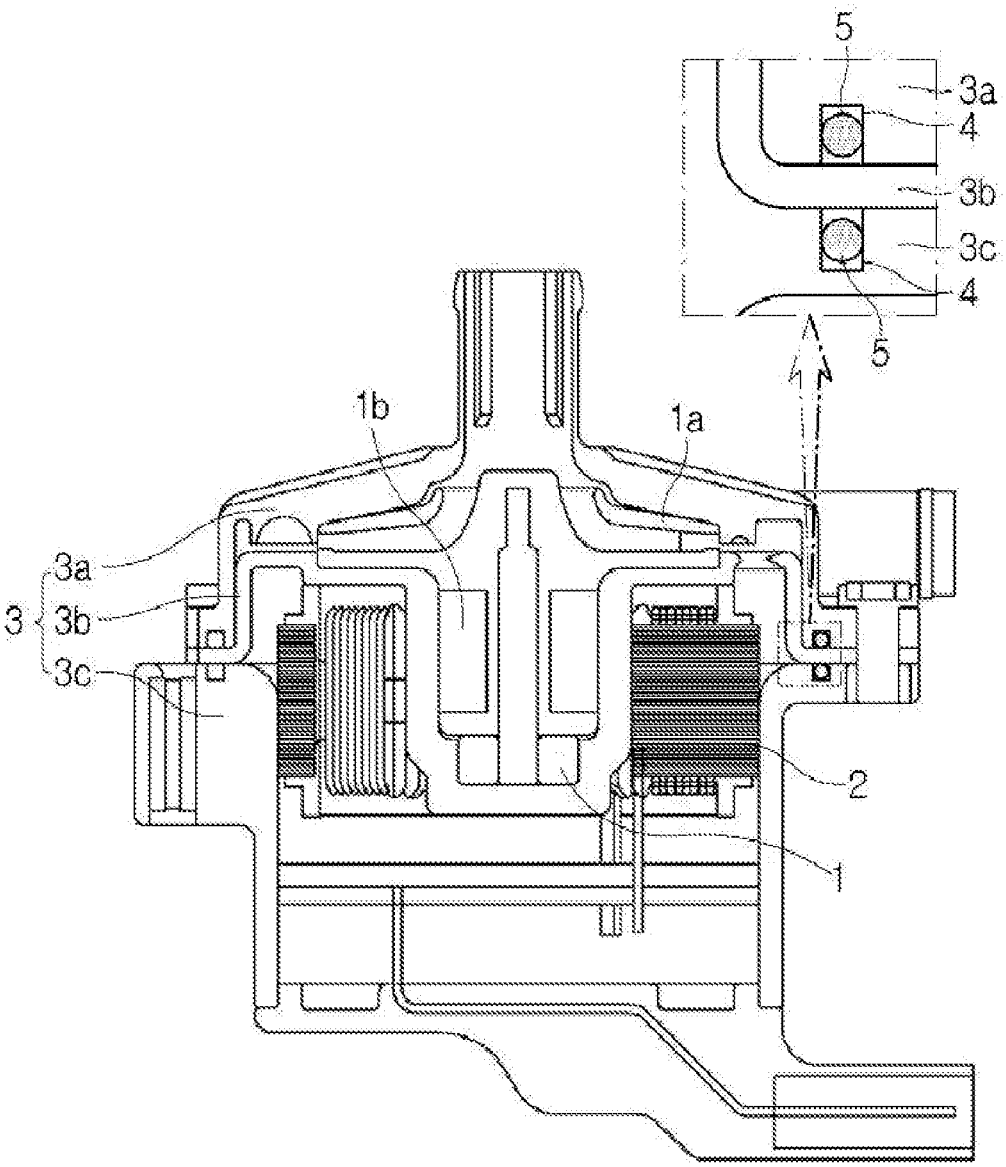
FIG. 1 (PRIOR ART)
FIG. 1 is a cross sectional view of a centrifugal pump having a sealing structure applied thereto according to a prior art.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein. The thickness of lines or the size of the component, etc., shown in the accompanying drawings may be exaggerated for clarity and convenience of description.

Also, the below-mentioned terms are defined in consideration of the functions in the present invention and may be changed according to the intention of users or operators or judicial precedents. Therefore, definitions of such terms should be made based on what has been described throughout the present specification.

Hereinafter, exemplary embodiments of the present disclosure will be described with reference to the accompanying drawings.

Figure 2:
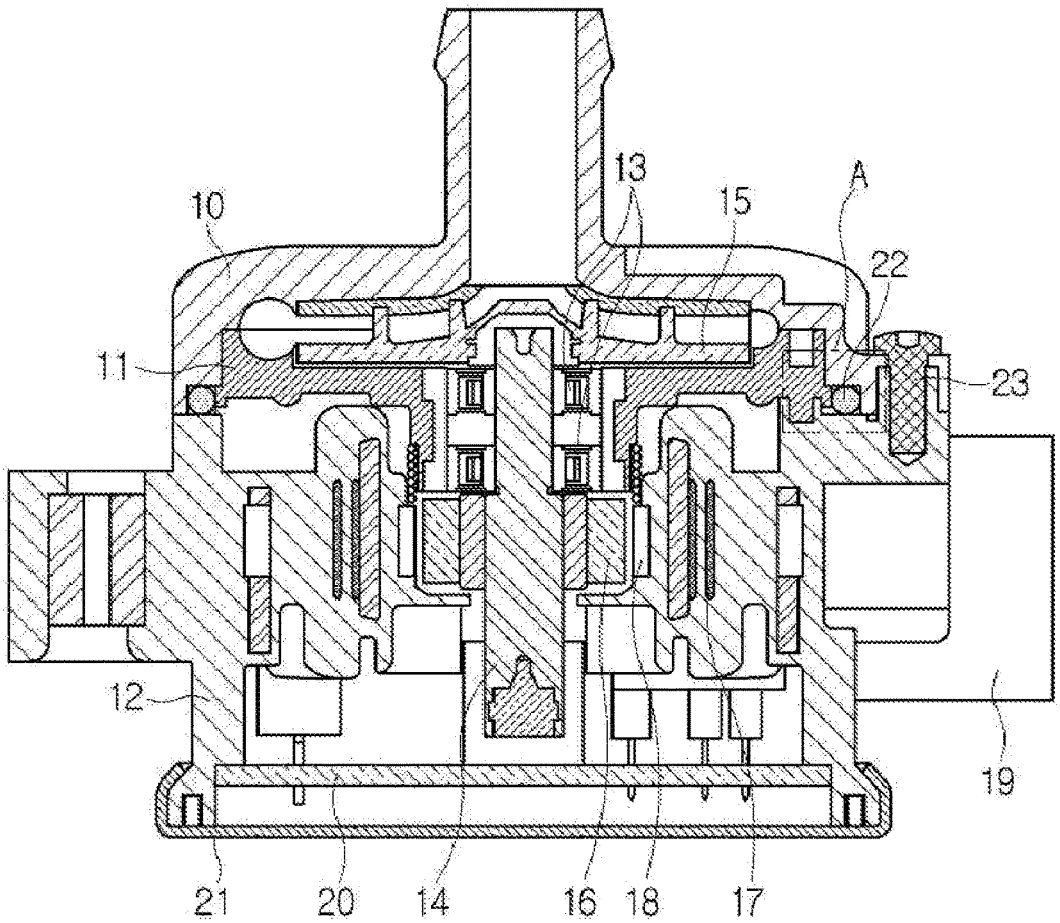
FIG. 2 is a cross sectional view of a centrifugal pump having a sealing structure applied thereto according to the present disclosure.

FIG. 2 is a cross sectional view of a centrifugal pump having a sealing structure applied thereto according to the present disclosure. As shown, a housing of the centrifugal pump includes a cover 10, a middle housing 11, and a lower housing 12.

The cover 10 has a fluid inlet and a fluid outlet formed therein, is seated on the lower housing 12, and is fixed to the lower housing 12 by a plurality of screws 23 arranged along the periphery.

The middle housing 11 is installed between the cover 10 and the lower housing 12. An upper space of the middle housing 11 corresponds to a fluid compression space in which a fluid is compressed by an impeller 15, and a lower space of the middle housing 11 corresponds to an electric component installation space in which electric components to be described later are installed. That is, the fluid compression space is formed by the cover 10 and the middle housing 11, and the electric component installation space is formed by the middle housing 11 and the lower housing 12.

The lower housing 12 is coupled to the lower side of the cover 10 by the screw 23 as described above, and a connector 19 for supplying power is formed.

A rotor shaft 14 is installed in an axial direction in the center inside the centrifugal pump. The upper end of the rotor shaft 14 passes through the middle housing 11 and protrudes into the fluid compression space, and the impeller 15 is installed at the end thereof.

The rotor shaft 14 is supported through the medium of a pair of upper and lower bearings 13 and can be rotated at a high speed. The pair of bearings 13 is inserted and installed into the inner circumferential surface of a cylindrical portion formed in the center of the middle housing 11.

A magnet 16 is installed on the outer peripheral surface of the middle portion of the rotor shaft 14, and a stator including a coil 17 and a core 18 is installed on the inner peripheral surface of the lower housing 12 in correspondence to the magnet 16. The coil 17 is electrically connected to a terminal of the connector 19 through a control circuit board 20.

Therefore, when a current is supplied to the coil 17 through the connector 19 and the control circuit board 20, a magnetic field is formed in the core 18 and a rotational force is generated in the magnet 16 in response to the magnetic field, so that the rotor shaft 14 rotates and the impeller 15 rotates accordingly. Therefore, the fluid is sucked into the cover 10, and the sucked fluid is compressed and discharged.

The control circuit board 20 is installed on the lower inner side of the lower housing 12 in order to control the electromagnetic force of the stator. A PCB cover 21 is installed at the bottom of the lower housing 12 such that the control circuit board 20 is not exposed to the outside.

Meanwhile, the present invention is characterized in that one sealing member 22 is installed where the cover 10, the middle housing 11, and the lower housing 12 meet each other. The position where the three parts of the cover 10, the middle housing 11, and the lower housing 12 meet each other is located in the upper periphery of the centrifugal pump as shown in FIG. 2.

Figure 3:
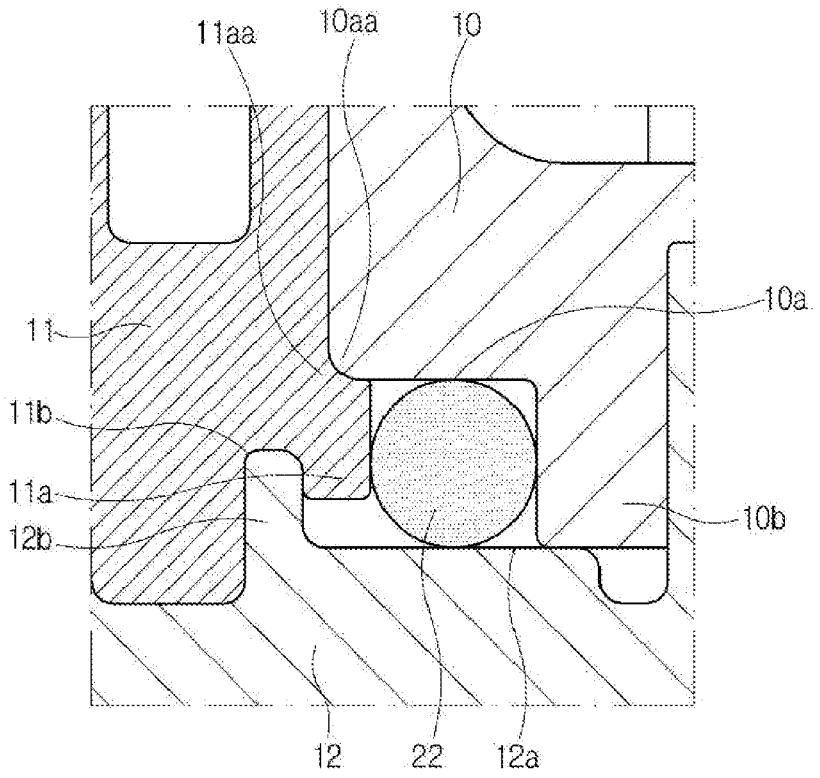
FIG. 3 is an enlarged view of a part "A" of FIG. 2 and is an enlarged cross-sectional view of a sealing member installation portion.

As shown in FIG. 3, an outer protrusion 10*b* is formed on a radially outer side portion of a bottom surface 10*a* of the cylindrical body of the cover 10, and a sealing member installation space in which the sealing member 22 is installed is formed inwardly from the outer protrusion 10*b*.

On the outer peripheral surface of the middle housing 11, a coupling protrusion 11*a* having a shape bent at a right angle is formed to protrude downward, and an upwardly concave coupling groove 11*b* is formed on the radially inner side of the coupling protrusion 11*a*. The outer surface of the coupling protrusion 11*a* forms one side of the sealing member installation space.

In addition, an inner edge 10*aa* of the bottom surface 10*a* of the cover 10 is seated on an upper edge 11*aa* of the coupling protrusion 11*a*.

The bottom surface of the sealing member installation space is formed by an upper surface 12*a* of the lower housing 12. An inner protrusion 12*b* is formed to protrude upward from a radially inner side portion of the upper surface 12*a* of the lower housing 12. The inner protrusion 12*b* is inserted into and coupled to the coupling groove 11*b* formed inwardly from the coupling protrusion 11*a* of the middle housing 11.

As described above, the coupling protrusion 11*a* of the middle housing 11 is in between the inner edge 10*aa* of the bottom surface 10*a* of the cover 10 and the inner protrusion 12*b* of the lower housing 12, so that the middle housing 11 can be more firmly coupled between the cover 10 and the lower housing 12.

As described above, the sealing member installation space with a rectangular cross section is formed by the bottom surface 10*a* of the cover 10, the upper surface 12*a* of the lower housing 12, the outer surface of the coupling protrusion 11*a* of the middle housing 11, and the inner surface of the outer protrusion 10*b* of the cover 10. The sealing member 22 is installed in the sealing member installation space.

The sealing member 22 is an overall ring shape with an O-ring circular cross section. In a state in which the sealing member 22 is installed in the sealing member installation space, upper, lower, left, and right ends are in close contact with peripheral parts forming the sealing member installation space.

That is, the upper end of the sealing member 22 is in close contact with the bottom surface 10*a* of the cover 10, the lower end is in close contact with the upper surface 12*a* of the lower housing 12. The left end is in close contact with the outer surface of the coupling protrusion 11*a* of the middle housing 11, and the right end is in close contact with the inner surface of the outer protrusion 10*b* of the cover 10, so that upper, lower, left, and right four-point contact occurs.

In addition, the sealing member installation space is connected respectively to a leakage path of the fluid compression space above the middle housing 11 and a leakage path of the electric component installation space below the middle housing 11 with respect to the middle housing 11.

Accordingly, the sealing member 22 in contact with the upper, lower, left, and right four points within the sealing member installation space is able to prevent the leakage of both the fluid compression space and the electric component installation space.

According to the present disclosure, as described above, it is possible to prevent the leakage of both the two upper and lower spaces with respect to the middle housing 11 by means of one sealing member 22, thereby reducing the number of sealing members required, compared to the prior art.

As the number of sealing members is reduced as described above, the sealing structure of the centrifugal pump is simplified.

Also, for the same reason as that described above, there is an effect that the number of assemblers required for assembling the sealing member is reduced. As described above, the number of components and the number of assemblers are reduced, thereby improving productivity and reducing production cost.

In addition, since the sealing member 22 comes in four-point contact and the number of contact points with surrounding components is increased, the sealing performance of the sealing member 22 is improved.

Figure 4:
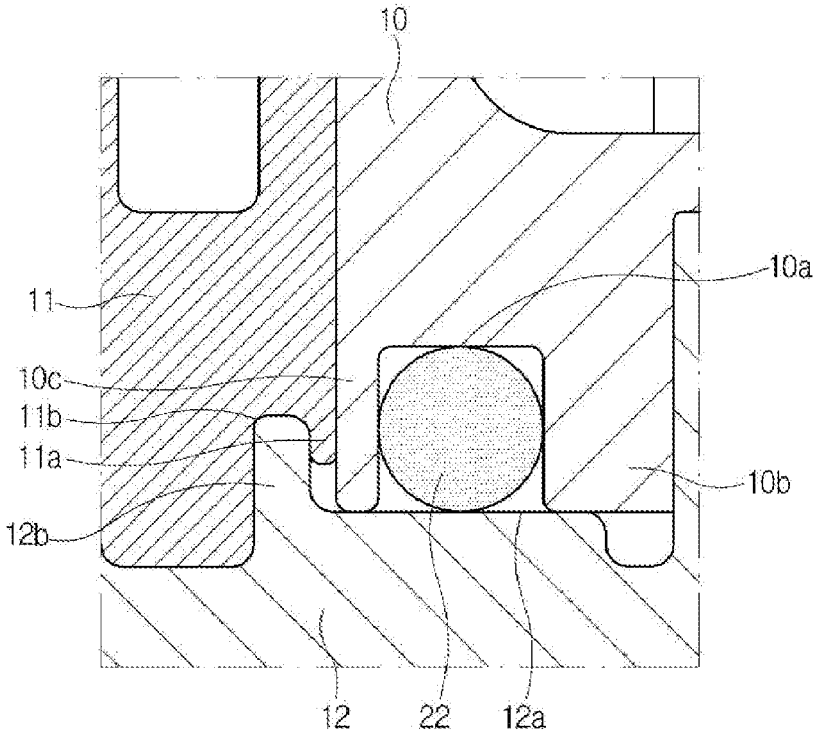
FIG. 4 is a view showing an embodiment of another structure of the part "A"

FIG. 4 is an enlarged cross-sectional view showing another embodiment of the sealing member installation portion. In this embodiment, an inner protrusion 10*c* corresponding to the outer protrusion 10*b* is formed on the bottom surface 10*a* of the body of the cover 10. The sealing member installation space is formed between the inner protrusion 10*c* and the outer protrusion 10*b*.

Both the lower ends of the inner protrusion 10*c* and the outer protrusion 10*b* are in contact with the upper surface 12*a* of the lower housing 12, and thus, the bottom surface of the sealing member installation space is formed by the upper surface 12*a* of the lower housing 12.

By forming the inner protrusion 10*c*, the thickness of the coupling protrusion 11*a* of the middle housing 11 is reduced. The outer surface of the coupling protrusion 11*a* forms the same surface as the outer peripheral surface of the middle housing 11 and does not protrude outward in the radial direction of the middle housing 11. In response to this, the inner surface of the inner protrusion 10*c* of the cover 10 also does not protrude inward in the radial direction with respect to the inner peripheral surface of the cover 10. Accordingly, the inner peripheral surface of the cover 10 including the inner protrusion 10*c* and the outer peripheral surface of the middle housing 11 including the coupling protrusion 11*a* are formed in a simple circumferential shape without unevenness and are in contact with each other.

The inner protrusion 12*b* formed on the radially inner side of the upper surface 12*a* of the lower housing 12 is inserted into and coupled to the coupling groove 11*b* formed on the radially inner side of the coupling protrusion 11*a* of the middle housing 11. This is the same as before.

In the state where the sealing member 22 is installed, upper, lower, left, and right ends of the sealing member 22 come in contact with the bottom surface 10*a* of the cover 10, the upper surface 12*a* of the lower housing 12, the inner protrusion 10*c* of the cover 10, and the outer protrusion 10*b* of the cover 10, so that four-point contact occurs.

Also in this embodiment, the leakage path from the fluid compression space above the middle housing 11 and the leakage path from the electric component installation space below the middle housing 11 pass through the sealing member installation space between the middle housing 11 and the cover 10 and between the middle housing 11 and the lower housings 12, so that it is possible to block the leakage of the two spaces by means of one sealing member 22. Accordingly, all the above-described effects caused by the reduction in the number of sealing members 22 can be obtained.

Figure 5:
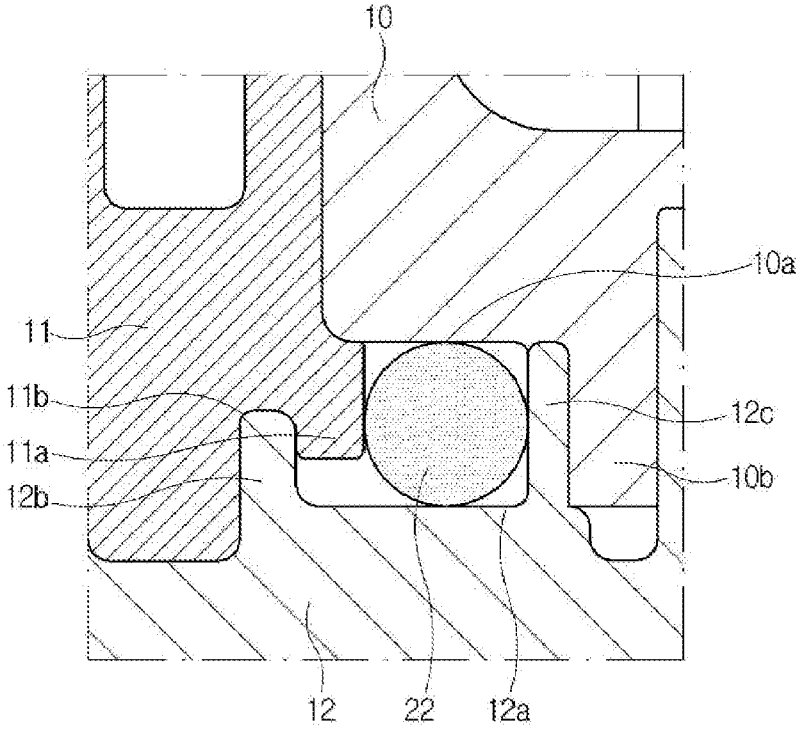
FIG. 5 is a view showing an embodiment of further another structure of the part "A".

FIG. 5 is an enlarged cross-sectional view showing further another embodiment of the sealing member installation portion.

In this embodiment, the coupling protrusion 11*a* is formed to protrude from the outer peripheral surface of the middle housing 11, and the coupling groove 11*b* is formed on the radially inner side of the coupling protrusion 11*a*. The inner protrusion 12*b* formed to protrude from the upper surface 12*a* of the lower housing 12 is inserted into and coupled to the coupling groove 11*b*. This is the same as the embodiment of FIG. 3.

In this embodiment, an outer protrusion 12*c* is formed to protrude upward from the radially outer side portion of the upper surface 12*a* of the lower housing 12, and the outer protrusion 12*c* is inserted into the inside of the outer protrusion 10*b* of the cover 10.

Accordingly, the upper, lower, left, and right four ends of the sealing member 22 are respectively in contact with the bottom surface 10*a* of the cover 10, the upper surface 12*a* of the lower housing 12, the outer surface of the coupling protrusion 11*a* of the middle housing 11, and the inner surface of the outer protrusion 12*c* of the lower housing 12, so that four-point contact occurs.

This embodiment also has the effect that both the leakage paths from the fluid compression space and the electric component installation space pass through the sealing member 22 installation portion, so that it is possible to seal the leakage of the two spaces by means of one sealing member.

In addition, since the sealing member 22 forms the four-point contact structure with the surrounding components, it is almost impossible for the fluid to pass through the sealing member 22, so that the sealing performance of the centrifugal pump is improved.

As described above, although the present invention has been described with reference to the embodiment shown in the drawings, this is just an example and it will be understood by those skilled in the art that various modifications and equivalent thereto may be made. Therefore, the true technical scope of the present invention should be determined by the appended claims.

According to the present disclosure as described above, two sealed spaces can be sealed by one sealing member, so that the number of sealing members is reduced.

Accordingly, the number of components is reduced, so that the structure becomes simpler and the number of assemblers required for assembling the sealing member is reduced.

In addition, the number of components and the number of assemblers are reduced, thereby reducing production cost.

In addition, the sealing member installation groove may be formed to have various structures. All the upper, lower, left, and right four ends of the sealing member come in contact with the surrounding components within the installation groove, so that four-point contact occurs, and thus, the sealing performance is improved.

| REFERENCE NUMERALS | |
|---|---|
| 10: Cover | 10a: Bottom Surface |
| 10b: Outer Protrusion | 10c: Inner Protrusion |
| 11: Middle Housing | 11a: Coupling Protrusion |
| 11b: Coupling Groove | 12: Lower Housing |
| 12a: Upper Surface | 12b; Inner Protrusion |
| 12c: Outer Protrusion | 13: Bearing |
| 14: Rotor Shaft | 15: Impeller |
| 16: Magnet | 17: Coil |
| 18: Core | 19: Connector |
| 20: Control Circuit Board | 21: PCB Cover |
| 22: Sealing Member | 23: Screw |

What is claimed is:

1. A centrifugal pump sealing structure comprising:

a fluid compression space formed between a middle housing and an associated cover;

an electric component installation space between the middle housing and a lower housing; and a sealing member installed at a position where flow paths from the fluid compression space and the electric component installation space are connected while ends of the cover, the middle housing, and the lower housing are adjacent to each other, wherein an upwardly concave coupling groove is formed on a radially inner side of a coupling protrusion of the middle housing, and wherein an inner protrusion formed on a radially inner side portion of an upper surface of the lower housing is inserted into and coupled to the coupling groove.

2. The centrifugal pump sealing structure of claim 1 wherein the middle housing and cover are connected.

3. The centrifugal pump sealing structure of claim 1, wherein a bottom surface of the cover is in contact with an upper end of the sealing member, wherein the upper surface of the lower housing is in contact with a lower end of the sealing member, wherein an outer surface of the coupling protrusion formed on an outer peripheral surface of the middle housing is in contact with a left end of the sealing member, and wherein an inner surface of an outer protrusion formed on a radially outer side portion of the bottom surface of the cover is in contact with a right end of the sealing member.

4. The centrifugal pump sealing structure of claim 1, wherein a bottom surface of the cover is in contact with an upper end of the sealing member, wherein the upper surface of the lower housing is in contact with a lower end of the sealing member, wherein an outer surface of an inner protrusion formed on a radially inner side portion of an upper surface of the cover is in contact with a left end of the sealing member, and wherein an inner surface of an outer protrusion formed on a radially outer side portion of the upper surface of the cover is in contact with a right end of the sealing member.

5. The centrifugal pump sealing structure of claim 1, wherein a bottom surface of the cover is in contact with an upper end of the sealing member, wherein the upper surface of the lower housing is in contact with a lower end of the sealing member, wherein an outer surface of the coupling protrusion formed on an outer peripheral surface of the middle housing is in contact with a left end of the sealing member, and wherein an inner surface of an outer protrusion formed on a radially outer side portion of the upper surface of the lower housing is in contact with a right end of the sealing member.

6. The centrifugal pump sealing structure of claim 1, wherein an inner edge of a bottom surface of the cover is seated on an upper edge of the coupling protrusion of the middle housing.

7. The centrifugal pump sealing structure of claim 1, wherein a rotor shaft is installed to pass through the middle housing, wherein one side end portion of the rotor shaft is positioned in the fluid compression space, and wherein an impeller is installed at the end portion.

8. The centrifugal pump sealing structure of claim 1, wherein a rotor shaft is installed to pass through the middle housing, wherein an other side end portion of the rotor shaft is positioned in the electric component installation space, wherein a magnet is installed on an outer peripheral surface of the rotor shaft, and wherein a stator comprising a coil and a core is installed on an inner peripheral surface of the lower housing in correspondence to the magnet.

9. The centrifugal pump sealing structure of claim 7, wherein a pair of upper and lower bearings supporting rotatably the rotor shaft is provided, and wherein the bearings are installed on an inner circumferential surface of a cylindrical portion formed in a center of the middle housing.

* * * * *